US008783807B2

(12) United States Patent
Shimada

(10) Patent No.: US 8,783,807 B2
(45) Date of Patent: Jul. 22, 2014

(54) IMAGE FORMING APPARATUS AND IMAGE FORMING METHOD

(75) Inventor: Yoshitaka Shimada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 124 days.

(21) Appl. No.: 13/463,416

(22) Filed: May 3, 2012

(65) Prior Publication Data

US 2012/0287190 A1 Nov. 15, 2012

(30) Foreign Application Priority Data

May 12, 2011 (JP) ..... 2011-107461

(51) Int. Cl.
*B41J 29/38* (2006.01)
*B41J 2/015* (2006.01)
*B41J 23/00* (2006.01)

(52) U.S. Cl.
USPC ..... 347/12; 347/5; 347/9; 347/21; 347/37

(58) Field of Classification Search
USPC ..... 347/5, 9, 12, 21
See application file for complete search history.

(56) References Cited

U.S. PATENT DOCUMENTS 6,863,392 B2 * 3/2005 Shimomura et al. ..... 347/100
7,244,021 B2 7/2007 Arai
7,407,277 B2 8/2008 Yoneyama
8,201,908 B2 * 6/2012 Tanoue et al. ..... 347/12
8,267,507 B2 * 9/2012 Mitsuzawa ..... 347/102
2005/0200679 A1 9/2005 Falser
2005/0237352 A1 10/2005 Yoneyama
2010/0194838 A1 8/2010 Mitsuzawa
2010/0245440 A1 * 9/2010 Usuda et al. ..... 347/14
2011/0096120 A1 * 4/2011 Taya ..... 347/20

FOREIGN PATENT DOCUMENTS

JP 2004-306591 11/2004
JP 2005199563 A * 7/2005 ..... B41J 2/01
JP 2005-254560 9/2005
JP 2008290286 A * 12/2008
WO 2005-105452 11/2005

OTHER PUBLICATIONS

Extended European Search Report dated Aug. 8, 2012 for European Patent Application No. 12167471.7.

* cited by examiner

*Primary Examiner* — Laura Martin
*Assistant Examiner* — Jeremy Bishop
(74) *Attorney, Agent, or Firm* — Workman Nydegger

(57) ABSTRACT

An image forming apparatus includes: a first nozzle group forming a main image; a second nozzle group ejecting auxiliary ink and lined up with the first nozzle group in a moving direction of the nozzle group; and a third nozzle group ejecting the auxiliary ink and positioned on a downstream side of a medium transport direction relative to the first nozzle group, in which ink is ejected from the first nozzle group on a region where the main image is formed in the image forming region on the medium in a first ejection operation, and auxiliary ink is ejected from the second nozzle group on a region where the main image is not formed in the image forming region, and, in an ejection operation after the first ejection operation, the auxiliary ink is ejected from the third nozzle group over the entire image forming region.

5 Claims, 10 Drawing Sheets

IMAGE FORMING APPARATUS AND IMAGE FORMING METHOD

BACKGROUND

The entire disclosure of Japanese Patent Application No: 2011-107461, filed May 12, 2011 is expressly incorporated by reference herein in its entirety.

1. Technical Field

The present invention relates to an image forming apparatus and an image forming method.

2. Related Art

Among printers which are image forming apparatuses, there are printers that repeat an ejection operation (pass) in which ink is ejected while a head moves in a moving direction, and a transport operation that transports a medium in a transport direction perpendicular to the moving direction. In addition, there are printers in which the ink (UV ink) that is ejected by the head is cured by the irradiation of ultraviolet light and an irradiated light source of ultraviolet light (for example, refer to JP-A-2005-254560).

For example, printers using UV ink adopt a printing method in which only a main image is formed on a part of an image forming region during a first pass and auxiliary ink (for example, clear ink) is ejected over the entire image forming region during a later pass. In this manner, since images formed by high viscosity ink such as UV ink have an image thickness, step differences occur between the region where the auxiliary ink is ejected on the main image and the region where only the auxiliary ink is ejected.

SUMMARY

Thus, an advantage of some aspects of the invention is to suppress step difference between the region where the main image is formed and the region where the main image is not formed.

According to an aspect of the invention, there is provided an image forming apparatus including: (A) a first nozzle group in which nozzles ejecting ink forming a main image are lined up in a predetermined direction; (B) a second nozzle group, in which nozzles ejecting auxiliary ink are lined up in the predetermined direction, lined up with the first nozzle group in a direction perpendicular to the predetermined direction; (C) a third nozzle group, in which nozzles ejecting the auxiliary ink are lined up in the predetermined direction, positioned on one side of the predetermined direction relative to the first nozzle group and the second nozzle group; and (D) a control unit that repeatedly performs an ejection operation ejecting ink from the nozzles while relatively moving the nozzle groups and the medium in the perpendicular directions and a transport operation moving the relative position of the medium with respect to the nozzle groups to one side of the predetermined direction, in which, in a first ejection operation, ink is ejected from the first nozzle group on the region where the main image is formed in the image forming region on the medium, and the auxiliary ink is ejected from the second nozzle group on the region where the main image is not formed in the image forming region, and, in an ejection operation after the first ejection operation, the auxiliary ink is ejected from the third nozzle group over the entire image forming region.

BRIEF DESCRIPTION OF THE DRAWINGS

The invention will be described with reference to the accompanying drawings, wherein like numbers reference like elements.

DESCRIPTION OF EXEMPLARY EMBODIMENTS

Overview of the Disclosure

Figure 1:
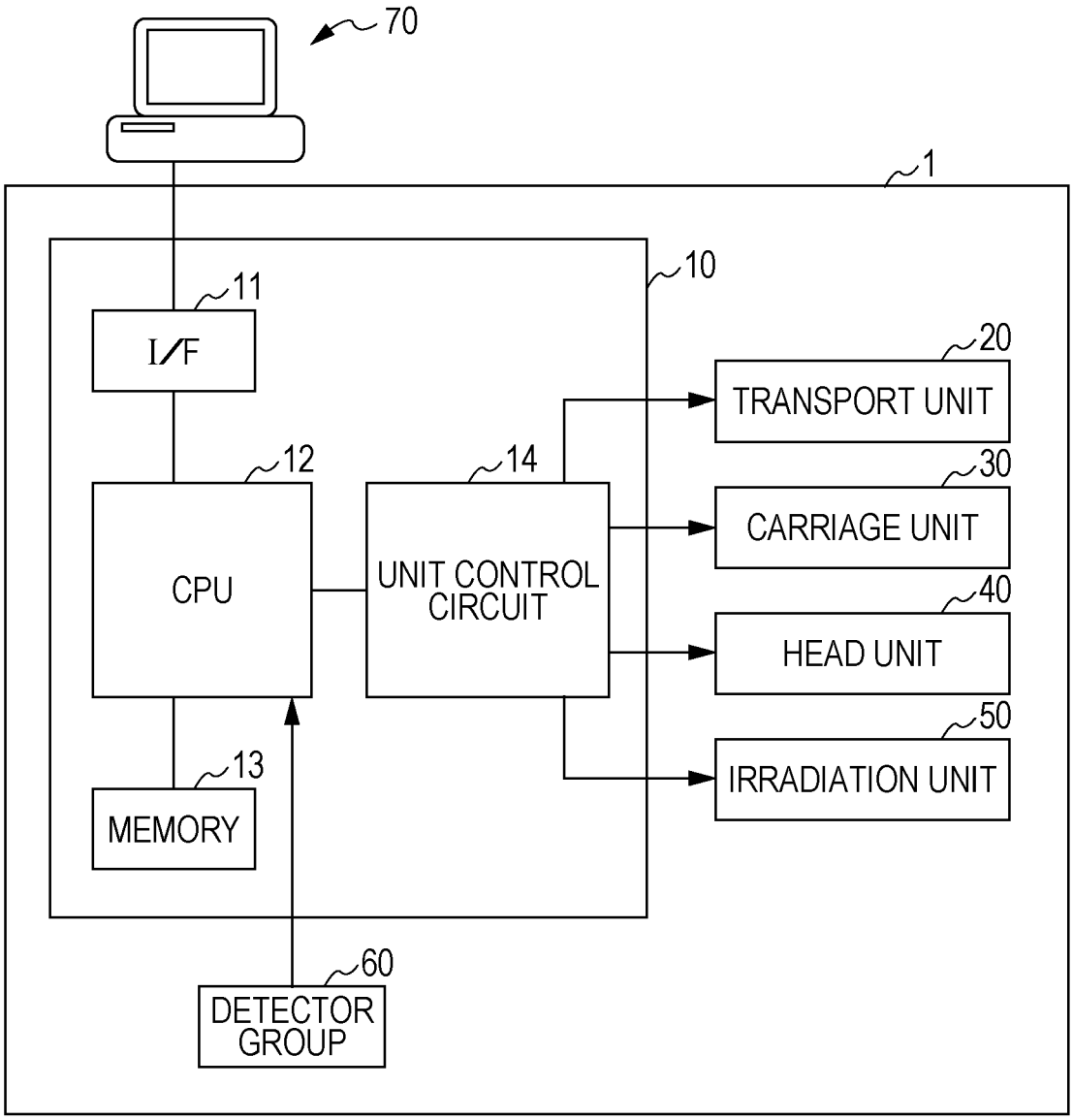
FIG. 1 is a configuration block diagram of an entire printer.

At least the following will be made clear by the description of the specification and the accompanying drawings.

In other words, there is provided an image forming apparatus including: (A) a first nozzle group in which nozzles ejecting ink forming a main image are lined up in a predetermined direction; (B) a second nozzle group, in which nozzles ejecting auxiliary ink are lined up in the predetermined direction, lined up with the first nozzle group in a direction perpendicular to the predetermined direction; (C) a third nozzle group, in which nozzles ejecting the auxiliary ink are lined up in the predetermined direction, positioned on one side of the predetermined direction relative to the first nozzle group and the second nozzle group; and (D) a control unit that repeatedly performs an ejection operation ejecting ink from the nozzles while relatively moving the nozzle groups and the medium in the perpendicular directions and a transport operation moving the relative position of the medium with respect to the nozzle groups to one side of the predetermined direction, in which, in a first ejection operation, ink is ejected from the first nozzle group on the region where the main image is formed in the image forming region on the medium, and the auxiliary ink is ejected from the second nozzle group on the region where the main image is not formed in the image forming region, and, in an ejection operation after the first ejection operation, the auxiliary ink is ejected from the third nozzle group over the entire image forming region.

According to the image forming apparatus, it is possible to form a two layer image in a region where a main image is formed and a region where the main image is not formed and to suppress step difference between the region where the main image is formed and the region where the main image is not formed.

In the image forming apparatus, the ink forming the main image and the auxiliary ink are photocurable ink cured by the irradiation of light.

According to the image forming apparatus, even in a case where image thickness is generated, it is possible to suppress step difference between the region where the main image is formed and the region where the main image is not formed.

The image forming apparatus includes a light irradiating unit that irradiates light to the photocurable ink and arranged to extend in at least the predetermined direction covering from the end portion of the other side of the predetermined direction of the first nozzle group and the second nozzle group to the end portion of the first side of the predetermined direction of the third nozzle group. In the ejection operation, the medium is relatively moved in a direction intersecting with the light irradiating unit and the nozzle groups, and between the predetermined directions of the first nozzle group, the second nozzle group, and the third nozzle group, a non-ejection region where ink is not ejected is provided.

According to the image forming apparatus, it is possible to eject auxiliary ink onto a main image in a state where the main image is sufficiently cured and it is possible to suppress image quality deterioration.

The above image forming apparatus may further include: a fourth nozzle group, in which nozzles ejecting ink forming a background image of the main image are lined up in the predetermined direction, positioned on the other side of the predetermined direction relative to the third nozzle group; and a fifth nozzle group, in which nozzles ejecting the auxiliary ink are lined up in the predetermined direction, lined up with the fourth nozzle group in the intersecting direction, in which, when the background image formed on the image forming region is smaller than the image forming region, the control unit performs another ejection operation ejecting ink from the fourth nozzle group to the region where the background image is formed in the image forming region and ejecting the auxiliary ink from the fifth nozzle group to the region where the background image is not formed in the image forming region.

According to the image forming apparatus, it is possible to suppress step difference generated in the image.

In addition, there is provided an image forming method forming an image on a medium using an image forming apparatus including: (A) a first nozzle group in which nozzles ejecting ink forming a main image are lined up in a predetermined direction; (B) a second nozzle group, in which nozzles ejecting auxiliary ink are lined up in the predetermined direction, lined up with the first nozzle group in a direction perpendicular to the predetermined direction; (C) a third nozzle group, in which nozzles ejecting the auxiliary ink are lined up in the predetermined direction, positioned on one side of the predetermined direction relative to the first nozzle group and the second nozzle group; and (D) a control unit that repeatedly performs an ejection operation ejecting ink from the nozzles while relatively moving the nozzle groups and the medium in the perpendicular directions and a transport operation moving the relative position of the medium with respect to the nozzle groups to one side of the predetermined direction, in which, in a first ejection operation, ink is ejected from the first nozzle group on the region where the main image is formed in the image forming region on the medium, and the auxiliary ink is ejected from the second nozzle group on the region where the main image is not formed in the image forming region, and, in an ejection operation after the first ejection operation, the auxiliary ink is ejected from the third nozzle group over the entire image forming region.

According to the image forming method, it is possible to form a two layer image in a region where a main image is formed and a region where the main image is not formed and to suppress step difference between the region where the main image is formed and the region where the main image is not formed.

Print System

Description will be given of the embodiments, wherein an example will be given of a print system in which an ink jet printer (hereinafter "printer") is set as the image forming apparatus, and the printer is connected with a computer.

Figure 2A:
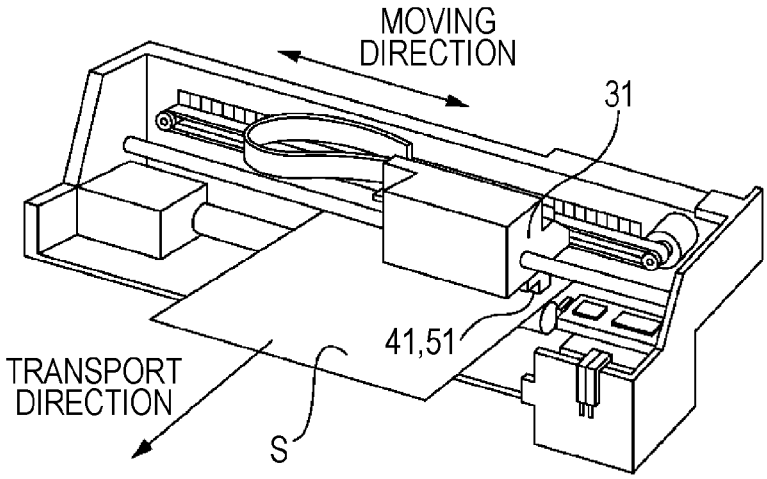
FIG. 2A is a schematic perspective view of a printer.
Figure 2B:
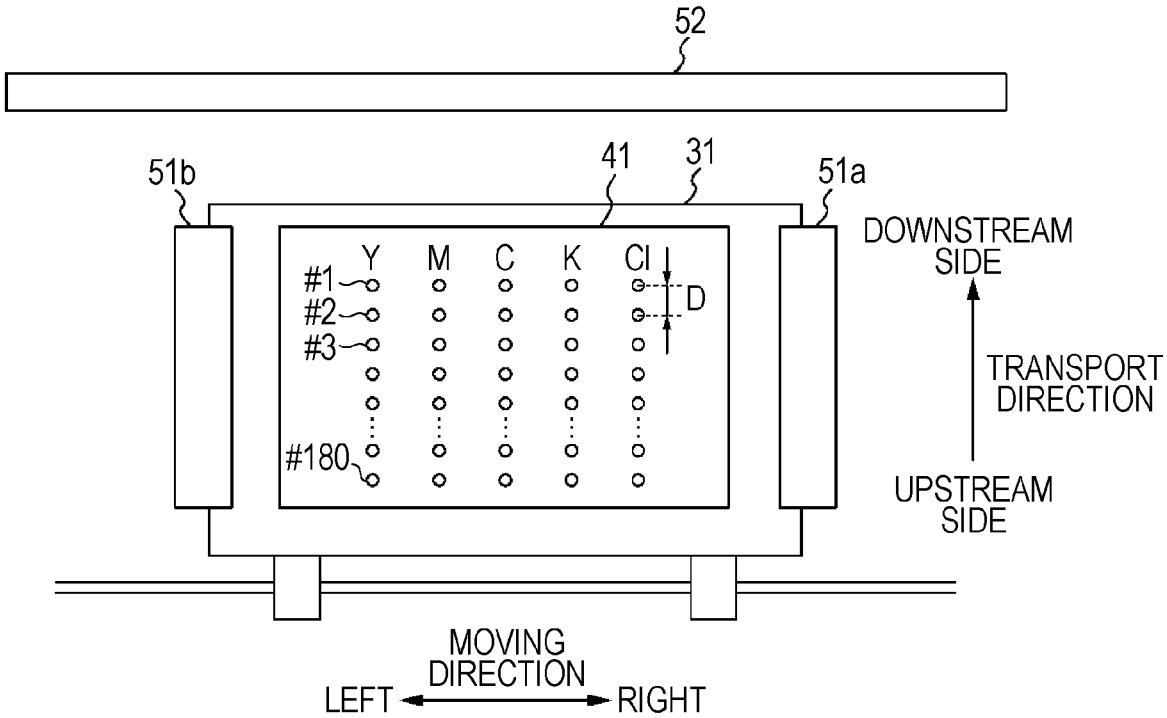
FIG. 2B is a diagram illustrating the periphery of a carriage.

FIG. 1 is a configuration block diagram of an entire printer 1, FIG. 2A is a schematic perspective view of a printer 1 and FIG. 2B is a diagram illustrating the periphery of a carriage 31. In addition, FIG. 2B virtually shows a nozzle array seen from above the head 41.

The printer 1 of the first embodiment prints an image on a medium S (for example, paper, cloth, or film) by ejecting ultraviolet curable ink cured by the irradiation of ultraviolet light. In addition, the ultraviolet curable ink (below, UV ink) is an ink that includes an ultraviolet curable resin and is cured by the occurrence of a light polymerization reaction in the ultraviolet curable resin when ultraviolet light is irradiated thereon.

A computer 70 is communicably connected with the printer 1 and outputs print data for printing an image in the printer 1 to the printer 1.

A controller 10 is a control unit that performs control of the printer 1. An interface unit 11 is for sending and receiving data between the computer 70 and printer 1. A CPU 12 is a processing unit that performs overall control of the printer 1. A memory 13 is for securing a region storing programs of the CPU 12 or an operation region. The CPU 12 controls each unit using a unit control circuit 14. In addition, a detector group 60 monitors the conditions in the printer 1 and the controller 10 controls each unit based on the detection result thereof.

The transport unit 20 is for feeding the medium S to a printable position and transporting the medium S by a predetermined transport amount in the transport direction during printing.

The carriage unit 30 is for moving a head 41 and the like mounted on a carriage 31 in a moving direction that is perpendicular to the transport direction.

The head unit 40 is for ejecting ink to the medium S and includes a head 41. On the lower surface of the head 41, as shown in FIG. 2B, a plurality of nozzle rows are formed in which nozzles ejecting ink are lined up at predetermined intervals (nozzle pitch D) in the transport direction. For illustrative purposes, for each of the nozzles belonging to the nozzle row, small numbers (#1, #2, . . . ) are given in order from the nozzles of the transport direction downstream side.

The printer 1 of the present embodiment is set to be capable of ejecting five kinds of ink (CMYK and Cl). In the head 41 are formed a yellow nozzle row Y ejecting yellow ink, a magenta nozzle row M ejecting magenta ink, a cyan nozzle row C ejecting cyan ink, a black nozzle row K ejecting black ink, and a clear nozzle row Cl ejecting clear ink.

In addition, the nozzles are in communication with an ink chamber filled with ink. The ink ejection system may be a piezo system ejecting ink that ejects from the nozzles by expanding and contracting the ink chamber by applying a voltage to a driving element (piezo element), or may be a thermal system using bubbles to eject ink from the nozzles by generating the bubbles in the nozzles using a heat generating element.

In the printer 1, the controller 10 (control unit) repeatedly performs an ejection operation ejecting ink from a nozzle while the head 41 moves in a moving direction with respect to a medium and a transport operation transporting a medium S with respect to the head 41 to a downstream side of the transport direction. As a result, dots are formed in a subsequent ejection operation at a position on the medium S different to the position of dots formed by a first ejection operation, whereby it is possible to print a two-dimensional image on the medium S. Below, one ejection operation by the head 41 will be referred to as a "pass".

The irradiation unit 50 is for irradiating ultraviolet light towards the UV ink that has landed on the medium S and thus curing the UV ink, and includes a provisional irradiation unit 51 and a main irradiation unit 52. In addition, example light sources of ultraviolet light irradiation include, for example, light-emitting diodes (LED), metal halide lamps, mercury lamps, and the like. In addition, the amount of irradiation (irradiation energy ($mJ/cm^2$)) of the ultraviolet light emitted by the irradiation unit per unit area is determined by the product of the irradiation intensity of the ultraviolet light ($mW/cm^2$) and the irradiation time (s).

As shown in FIG. 2B, the provisional irradiation units 51*a* and 51*b* are provided on both end portions in the moving direction of the carriage 31 and move in the moving direction with the head 41 along with the movement of the carriage 31. In addition, the provisional irradiation units 51*a* and 51*b* extend in the transmission station in the same manner as the nozzle rows. Thus, the UV ink ejected from the head 41 during the movement in the moving direction is irradiated with ultraviolet light by the provisional irradiation units 51*a* and 51*b* as soon as the ink lands on the medium S.

The UV ink ejected from the head 41 during the outbound movement in which the carriage 31 moves to the left side of the moving direction is irradiated by ultraviolet light according to the first provisional irradiation unit 51*a* positioned at the right side of the moving direction. Conversely, the UV ink ejected from the head 41 during the inbound movement in which the carriage 31 moves to the right side of the moving direction is irradiated by ultraviolet light according to the second provisional irradiation unit 51*b* positioned at the left side of the moving direction.

The main irradiation unit 52 is provided so as to be fixed at the downstream side of the transport direction in relation to the carriage 31. The length of the moving direction of the main irradiation unit 52 is the length of the moving direction of the medium S or more and the main irradiation unit 52 irradiates ultraviolet light to the UV ink on the medium S passing from below. Thus, the UV ink on the medium S is completely cured by the main irradiation unit 52 and the image is completed by the UV ink.

Print Method

First Embodiment

The printer 1 of the present embodiment executes a print method ejecting colorless and transparent clear ink from on the main image (color image or monochrome image) to be printed using the inks of four colors (CMYK). That is, the printer 1 prints an image in which an image using clear ink (below, clear image) overlaps with the main image using the inks of four colors. By doing so, it is possible to improve the glossiness of the image or to prevent rubbing or peeling of the main image or medium (that is, to protect the main image or medium). In other words, the clear ink (auxiliary ink) acts as coating ink forming a coating layer covering the main image and medium. In addition, the clear ink is not limited to being colorless and transparent and may be colored and transparent, for example.

Print Method of Comparative Example

Figure 3A:
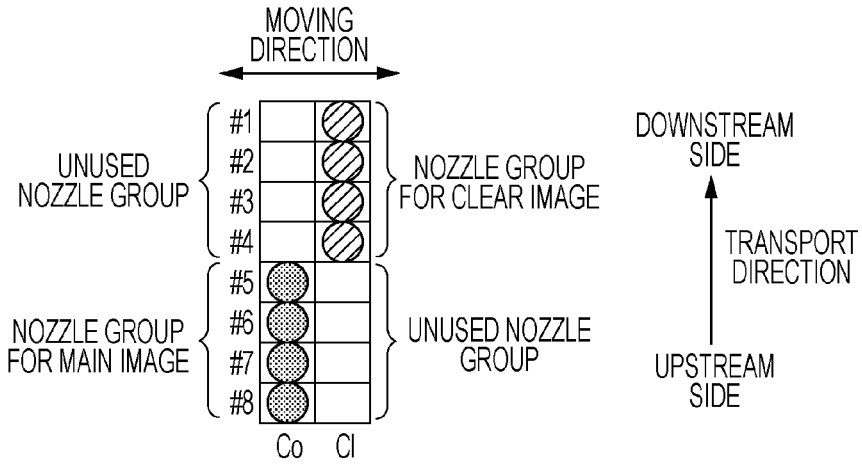
FIG. 3A is a diagram illustrating a nozzle used in a printing method of a comparative example.
Figure 3B:
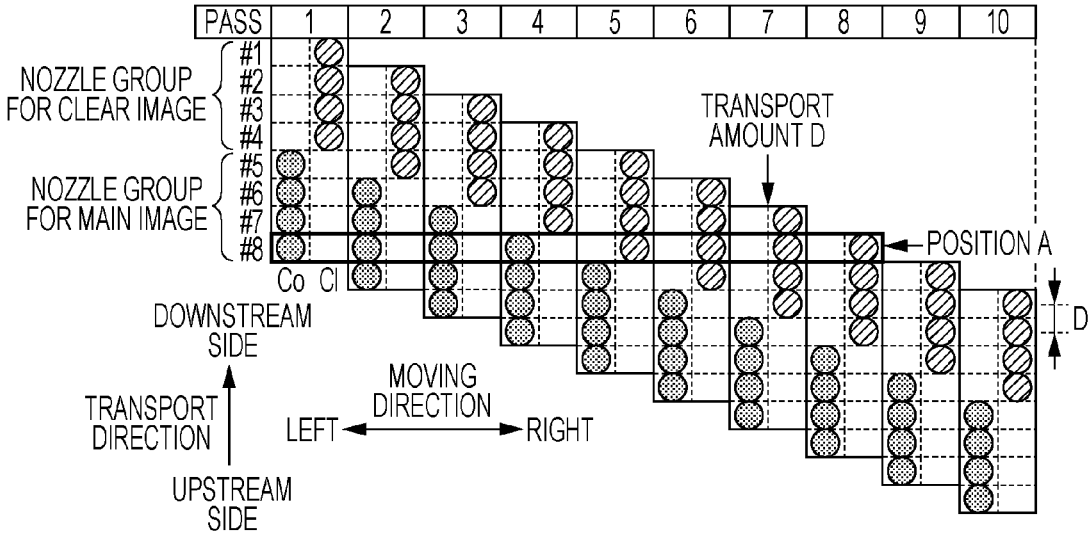
FIG. 3B is a diagram illustrating the printing method of a comparative example.
Figure 3C:
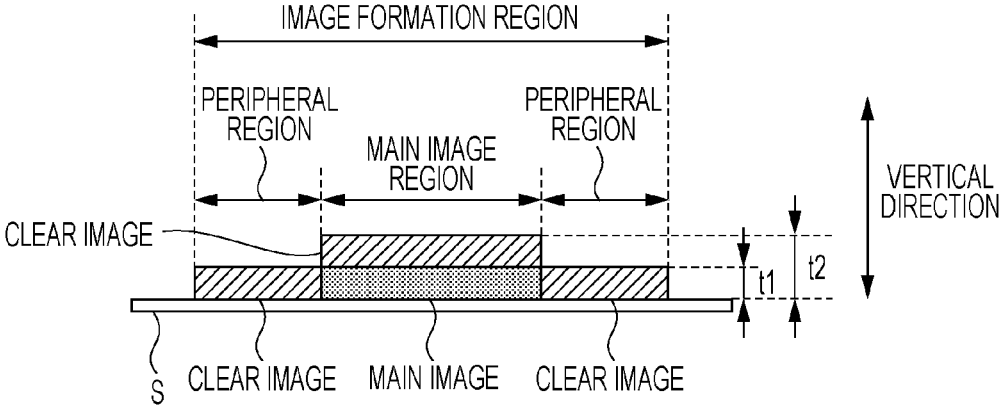
FIG. 3C is a diagram illustrating an image printed by the printing method of a comparative example.

FIG. 3A is a diagram illustrating a nozzle used in the printing method of a comparative example. FIG. 3B is a diagram illustrating a printing method of a comparative example. FIG. 3C is a diagram illustrating an image printed by the printing method of a comparative example. In the drawings, for convenience of explanation, the number of nozzles belonging to one nozzle row is reduced (#1 to #8), and the nozzle rows respectively ejecting the four colored inks (CMYK) are shown collectively as "color nozzle row Co". In addition, in practice, the medium is transported to the transport direction downstream side with respect to the head 41; however, in FIG. 3B, in order to show the relative positional relationship of the head 41 of each pass, the head 41 is shown shifted to the transport direction upstream side.

In the comparative example, in order to form a clear image on the main image, among the nozzles (#1 to #8) belonging to the color nozzle row Co, nozzle groups (#1 to #4) of the transport direction downstream side half are referred to as "unused nozzle groups", and nozzle groups (#5 to #8) of the transport direction upstream side half are referred to as "nozzle groups for the main image" for forming the main image. Meanwhile, among the nozzles (#1 to #8) belonging to the clear nozzle row Cl, nozzle groups (#1 to #4) of the transport direction downstream side half are referred to as "nozzle groups for the clear image" for forming the clear image, and nozzle groups (#5 to #8) of the transport direction upstream side half are referred to as "unused nozzle groups for the main image".

Here, the main image and the clear image are set to be printed by different nozzle groups with four passes respectively. That is, the dot rows along the moving direction configuring each image (below, referred to as a raster line) are set to be printed by different nozzles with four passes. In addition, in a single pass, dots are formed in pixel regions of one quarter of the pixel regions (unit region defined on the medium according to the level of printing resolution) lined up in the moving direction, and dots are set to be formed at all the pixel regions lined up in the moving direction with four passes. For this reason, in FIG. 3B, the medium transport amount corresponding to each pass is set to the nozzle pitch D. However, without being limited thereto, it may be set such that dots are formed at all the pixel regions lined up in the moving direction with each pass and dots of the same color may be formed to overlap four times with four passes. Further, a print method in which each raster line configuring the main image and clear image is printed by a single pass respectively may be adopted.

In addition, to aid the description, as shown in FIG. 3C, on the medium S, the region where an image is formed (that is, a region of the medium where ink is ejected) is referred to as an "image forming region", the region where the main image is formed in the image forming region is referred to as a "main image region", and the region where the main image is not formed in the image forming region (that is, a region where the clear image is formed) is referred to as a "peripheral region". In addition, in the drawings, the image forming region is shown to be smaller than the medium S; however, without being limited thereto, the entirety of the medium S may be coated with clear ink.

By repeating the ejection operation using the nozzle group for the main image and the nozzle group for the clear image and the transport operation transporting the medium to the transport direction downstream side by the transport amount D, the printer 1 performs printing as shown in FIG. 3B. For example, the medium part in which the position of the transport direction is position A corresponds to the nozzle groups for the main image in pass 1 to pass 4 and four color inks (CMYK) are ejected to the main image region in the medium part of position A, whereby (a part of) a main image is formed. Thereafter, the medium part of position A corresponds to the nozzle groups for the clear image in pass 5 to pass 8 and clear ink is ejected on the entire image forming region in the medium part of position A.

By setting the nozzle groups of the clear nozzle row Cl to be shifted and positioned at the transport direction downstream side relative to the nozzle groups for the main image in this manner as the "nozzle groups for the clear image", it is possible to form an overlapping clear image on top of the main image so as to coat the main image as shown in FIG. 3C.

However, in the comparative example, the nozzle groups of the clear nozzle row Cl lined up with the nozzle groups for the main image in the moving direction are set as the "unused nozzle groups". Therefore, the main image and the clear image are formed by only one layer, respectively. Thus, as shown in FIG. 3C, in the main image region in the image forming region, a two layer image in which the main image and the clear image overlap is formed, and, with respect thereto, in the peripheral region in the image forming region, only a clear image of a single layer is formed.

Since the UV ink used by the printer 1 of the present embodiment has a high viscosity and does not easily spread on the medium, even with a single layer image, there is image thickness in the image printed by the UV ink. Thus, as shown in FIG. 3C, the difference between the thickness t2 of the image (two layer image in which the main image and the clear image are overlapped) formed in the main image region and the thickness t1 of the image (single layer clear image) formed in the peripheral region becomes large.

In other words, in images printed by the print method of the comparative example, there is a two layer image part in which a main image and a clear image are overlapped and a single layer image part with one layer of only a clear image, whereby a step difference occurs in the image (that is, the image surface becomes uneven in shape). When the step difference occurs in the image, for example, glossiness of the image is lost, or the image may be rubbed and peeled off by catching on things.

Thus, in the present embodiment, the object is to suppress step difference between the region where the main image is formed (main image region) and the region where the main image is not formed (peripheral region) and to make the image surface as flat as possible.

Print Method of First Embodiment

Figure 4A:
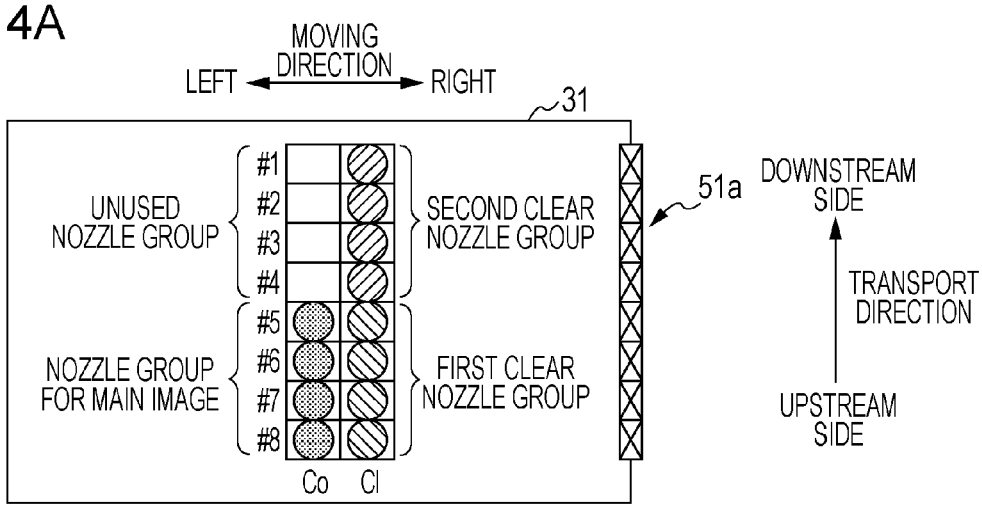
FIG. 4A is a diagram illustrating a nozzle used in a printing method of a first embodiment.
Figure 4B:
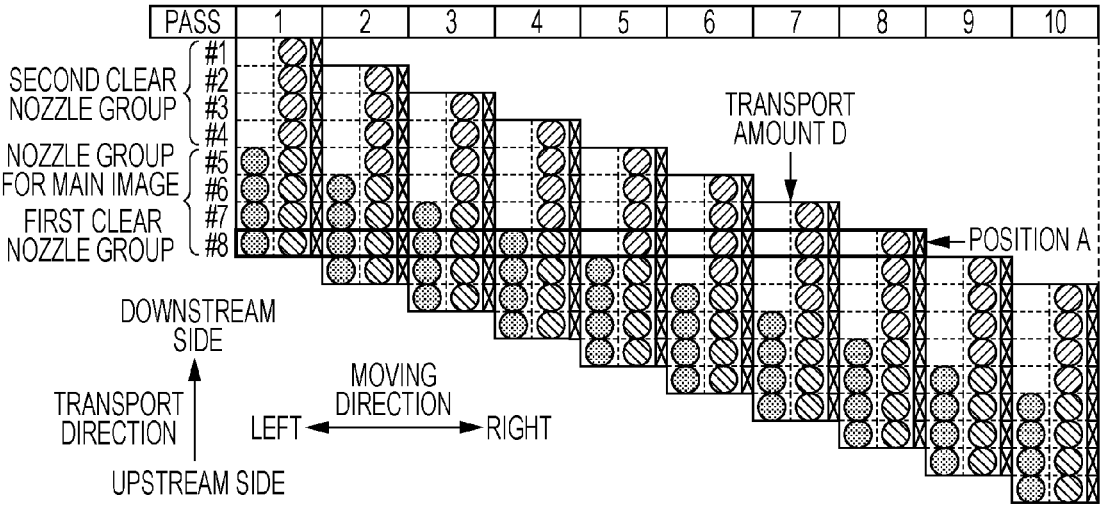
FIG. 4B is a diagram illustrating the printing method of the first embodiment.
Figure 4C:
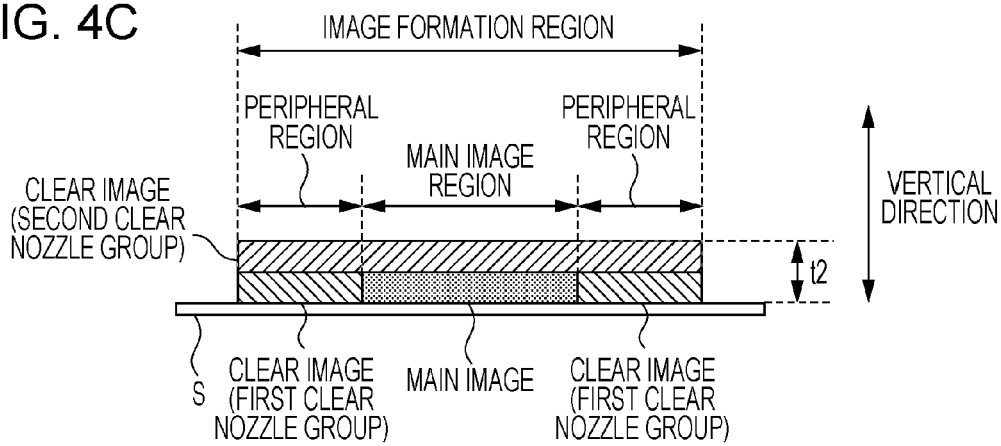
FIG. 4*c* is a diagram illustrating an image printed by the printing method of the first embodiment.

FIG. 4A is a diagram illustrating a nozzle used in a printing method of a first embodiment. FIG. 4B is a diagram illustrating the printing method of the first embodiment. FIG. 4C is a diagram illustrating an image printed by the printing method of the first embodiment. In addition, in the same manner as the comparative example, the raster lines respectively configuring the main image and the background image are printed by different nozzles with four passes, dots are set to be formed in one quarter of the pixel region lined up in the moving direction in each pass, and the medium transport amount in a single transport operation is set to nozzle pitch D.

In addition, in the printer 1 of the present embodiment, provisional irradiation units 51*a* and 51*b* irradiating ultraviolet light to both end portions in the moving direction of the carriage 31 are provided; however, for convenience of description, a print method (that is, unidirectional printing) in which the head 41 ejects ink only when the carriage 31 moves to the left side in the moving direction (when outbound) will be given as an example, whereby only the first provisional irradiation unit 51*a* of the opposite side (right side) to the side to which the head 41 moves irradiates ultraviolet light and the second provisional irradiation unit 51*b* (not shown) of the side (left side) to which the head 41 moves does not irradiate ultraviolet light.

In the first embodiment, in order to form a clear image overlapping on the main image, nozzle groups (#5 to #8) of the transport direction upstream side half of the color nozzle row Co are referred to as "nozzle groups for a main image (corresponding to the first nozzle group)", and nozzle groups (#1 to #4) of the transport direction downstream side half of the color nozzle row Co are referred to as "unused nozzle groups". Meanwhile, nozzle groups (#5 to #8) of the transport direction upstream side half of the clear nozzle row Cl are referred to as a "first clear nozzle group (corresponding to the second nozzle group)" for printing the clear image, and nozzle groups (#1 to #4) of the transport direction downstream side half of the clear nozzle row Cl are referred to as a "second clear nozzle group (corresponding to the third nozzle group)" for printing the same clear image. That is, the nozzle group for the main image and the first clear nozzle group are lined up in the moving direction and the second clear nozzle group is positioned (corresponding to the first side of the predetermined direction) at the downstream side of the transport direction relative to the nozzle group for the main image and the first clear nozzle group.

By repeating the ejection operation using the nozzle group for the main image, the first clear nozzle group, and the second clear nozzle group and the transport operation transporting the medium to the transport direction downstream side by the transport amount D, the printer 1 performs printing as shown in FIG. 4B.

For example, the medium part in which the position of the transport direction is position A corresponds to the nozzle group for the main image and the first clear nozzle group in pass 1 to pass 4. Therefore, in pass 1 to pass 4, the nozzle group for the main image ejects four colors of ink (CMYK) to the "main image region" in the medium part of position A and the first clear nozzle group ejects clear ink to a "peripheral region (region where the main image is not formed)" in the medium part of position A. At this time, the first provisional irradiation unit 51*a* irradiates ultraviolet light to the ink landed on the medium part of position A.

Thereafter, the medium part of position A corresponds to the second clear nozzle group in pass 5 to pass 8. Therefore, in pass 5 to pass 8, the second clear nozzle group ejects clear ink to the "entire image formation region (region combining the peripheral region and the main image region)" in the medium part of position A. At this time, the first provisional irradiation unit 51*a* irradiates ultraviolet light to the ink landed on the medium part of position A.

In this manner, in the first embodiment, the controller 10 ejects ink from the nozzle group for the main image to the main image region forming the main image in the image formation region in the medium with predetermined passes (one ejection operation), ejects clear ink from the first clear nozzle group to the peripheral region where the main image is not formed in the image formation region, and ejects clear ink from the second clear nozzle group to the entire image formation region in passes following the predetermined passes. In other words, in the first embodiment, while the main image is formed by the nozzle group for the main image, a clear image is formed (where the main image is not formed) by the first clear nozzle group that is lined up with the nozzle group for the main image along the moving direction.

In addition, the nozzle group for the main image forms a (part of a) main image in each pass with respect to the main image region in the medium part to which the nozzle group for the main image corresponds in each pass, the first clear nozzle group forms a (part of a) clear image in each pass with respect to the peripheral region in the medium part to which the first clear nozzle group corresponds in each pass, and the second clear nozzle group forms a (part of a) clear image in each pass with respect to the entire image formation region in the medium part to which the second clear nozzle group corresponds in each pass.

As a result, as shown in FIG. 4C, it is possible to form a clear image to overlap on the main image so as to coat the main image, and furthermore, it is possible to form a two layer image in which the main image and the clear image are overlapped in the main image region and to form a two layer image in which two clear images are overlapped in the peripheral region. Therefore, the image thickness t2 may be set close to a constant level in the main image region where the main image is formed and the peripheral region where the main image is not formed, whereby it is possible to suppress step difference generated in the image. That is, it is possible to improve the flatness of the image, provide a sense of glossiness to the image, or to prevent the rubbing or peeling off of the image.

As in the printer 1 of the present embodiment, when the four colored inks (CMYK) forming the main image and the clear ink (auxiliary ink) are UV ink (photocurable inks) cured by being irradiated with ultraviolet light, in particular, the thickness of a single layer image becomes thick and step difference is easily generated according to the difference in the number of overlapping images.

Therefore, in the printer 1 using UV ink, printing as in the first embodiment (FIG. 4) is more effective. In other words, according to the first embodiment, it is possible to suppress step difference generated in the image even when thickness is generated in the image.

Print Method

Second Embodiment

In the print method of the above-described first embodiment (FIG. 4), the nozzle groups of the side immediately downstream of the nozzle group for the main image (#5 to #8 of Co) are set as the second clear nozzle group (#1 to #4 of Cl) ejecting clear ink onto the main image. Therefore, when the printing of the main image with respect to the predetermined region of the medium is finished, clear ink is ejected onto the main image in the immediately following pass. When the length of time for which the provisional irradiation unit 51*a* irradiates ultraviolet light on the UV ink on the medium in a single pass is short, there are times when the UV ink on the medium is not sufficiently cured by the irradiation amount of the ultraviolet light irradiated from the provisional irradiation unit 51*a* in a single pass. In particular, in the main image printed on the medium part of position A, curing defects are easily generated at the part of the main image printed by the final pass 4.

When clear ink is ejected in a state in which the curing of the main image is insufficient, for example, there are problems such as peeling of the image, and aggregation or bleeding of the ink, and the clear ink may be buried by the main image. Further, when the main image is printed by a plurality of passes, if clear ink is ejected by the pass immediately following the completion of the printing of the main image, there is a risk that the clear ink will be ejected from above in a state where the degree of curing differs between the part of the main image printed by the preceding passes and the part of the main image printed by the subsequent passes. As a result of this, irregular colors may be generated in the image. In this manner, when clear ink is ejected onto the main image in a state where the curing of the main image is insufficient, the image quality deteriorates.

Figure 5A:
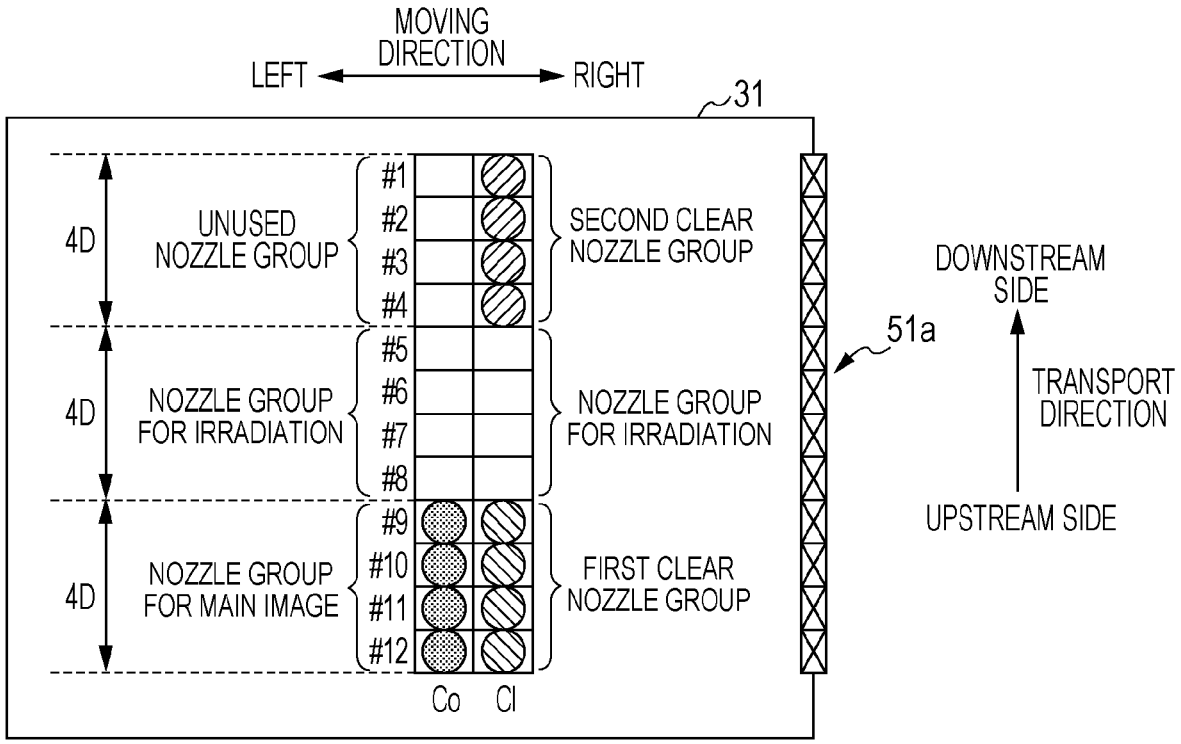
FIG. 5A is a diagram illustrating a nozzle used in a printing method of a second embodiment.
Figure 5B:
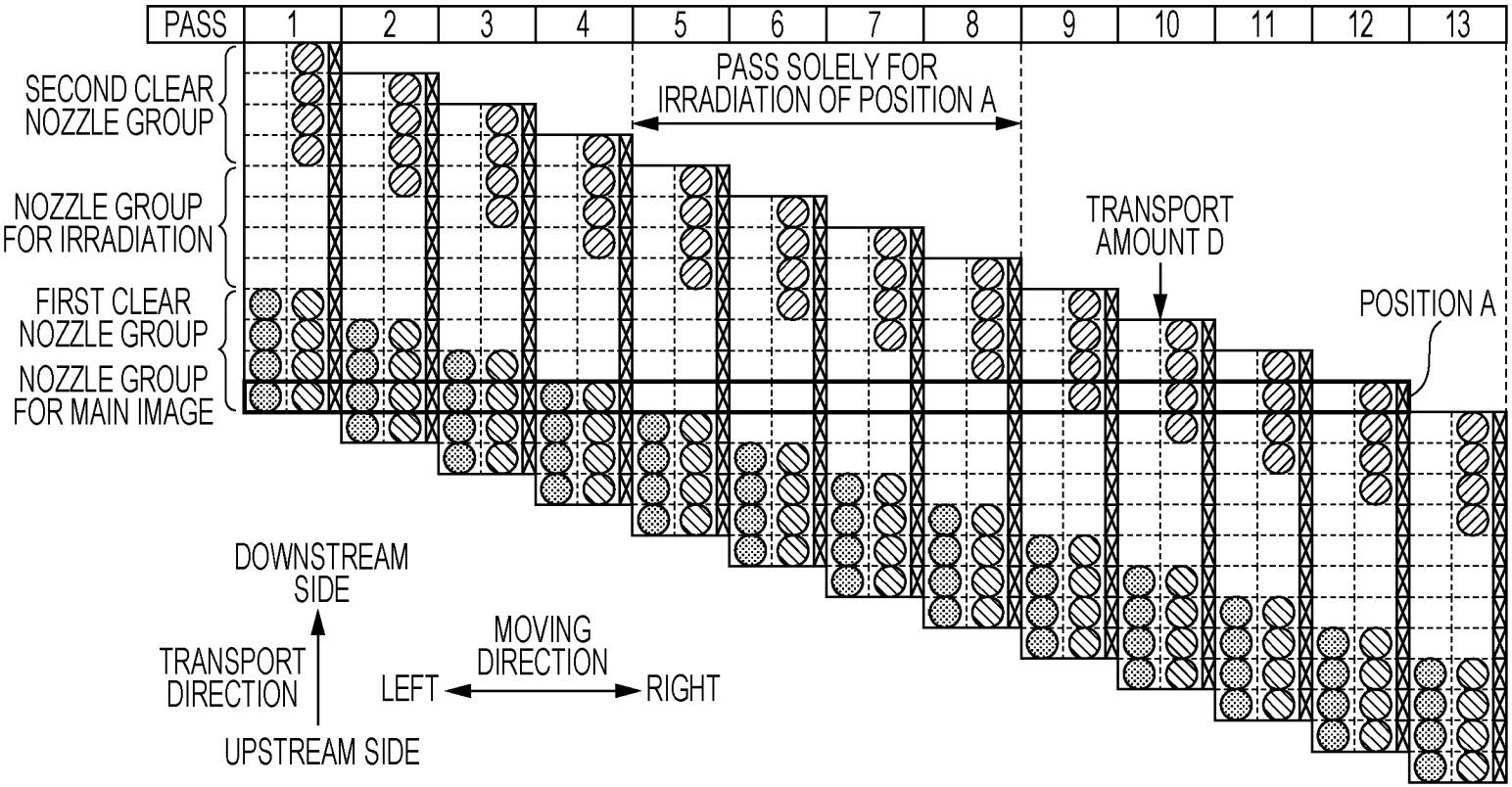
FIG. 5B is a diagram illustrating the printing method of the second embodiment.

FIG. 5A is a diagram illustrating a nozzle used in a printing method of a second embodiment. FIG. 5B is a diagram illustrating the printing method of the second embodiment. In the second embodiment, nozzle groups (#9 to #12) of one third of the transport direction upstream side of the color nozzle row Co are refer to as "nozzle groups for a main image", nozzle groups (#1 to #4) of one third of the transport direction downstream side are referred to as "unused nozzle groups", and nozzle groups (#5 to #8) of one third of the transport direction center are referred to as "nozzle groups for irradiation". On the other hand, nozzle groups (#9 to #12) of one third of the transport direction upstream side of the color nozzle row Cl are referred to as "first clear nozzle groups", and nozzle groups (#1 to #4) of one third of the transport direction downstream side are referred to as "second clear nozzle groups", and nozzle groups (#5 to #8) of one third of the transport direction center are referred to as "nozzle groups for irradiation".

In the same manner as the unused nozzle groups, the "nozzle groups for irradiation" are nozzle groups which do not eject ink onto the medium. However, the unused nozzle groups are lined up in the moving direction with the second clear nozzle group printing the control image. Therefore, clear ink is ejected to the medium part corresponding to the unused nozzle groups in a certain pass. Meanwhile, the positions of the transport direction of the nozzle groups for irradiation respectively set in the color nozzle row Co and the clear nozzle row Cl are equal, and the nozzle groups for irradiation are lined up together in the moving direction. Therefore, at the medium part corresponding to the nozzle groups for irradiation in a certain pass, ink is not ejected and only ultraviolet light is irradiated by the provisional irradiation units 51*a* and 51*b*. That is, the nozzle groups for irradiation are nozzle groups for providing a dedicated irradiation pass in which the provisional irradiation units 51*a* and 51*b* irradiate ultraviolet light to the UV ink already landed at the corresponding medium part.

FIG. 5B shows the result of performing printing in this kind of nozzle set. For example, while being irradiated with ultraviolet light by the first provisional irradiation unit 51*a* in pass 1 to pass 4, four colored inks are ejected from the nozzle group for the main image to the main image region of the medium part in which the position of the transport direction is position A, and clear ink is ejected from the first clear nozzle group to the peripheral region.

Thereafter, since the medium part of position A corresponds to the nozzle groups for irradiation (#5 to #8 of Co and Cl) in pass 5 to pass 8, the first provisional irradiation unit 51*a* only irradiates ultraviolet light to the ink landed at the medium part of position A and ink is not ejected to the medium part of position A. Therefore, the main image (and clear image) printed at the medium part of position A in pass 1 to pass 4 may be sufficiently cured before the clear ink is ejected from above.

Thereafter, in pass 9 to pass 12, the medium part of position A corresponds to the second clear nozzle group and clear ink is ejected from the second clear nozzle group onto the sufficiently cured main image (and clear image).

In other words, in the second embodiment, the nozzles positioned between the transport directions of the nozzle groups for the main image and the first clear nozzle groups and the second clear nozzle groups are set as nozzle groups for irradiation (non-ejection nozzles), and, between the transport directions of the nozzle groups for the main image and the first clear nozzle groups and the second clear nozzle groups, a "non-ejection region" where ink is not ejected is provided.

By doing so, after the main image (and the clear image by the first clear nozzle groups) is printed in a predetermined region of the medium, since the main image on the predetermined region of the medium (and the clear image) correspond to the nozzle groups for irradiation (non-ejection region) which are not the second clear nozzle groups, they are sufficiently cured by the ultraviolet light from the provisional irradiation units 51*a* and 51*b* therebetween. In other words, it is possible to print an overlapping clear image using the second clear nozzle groups in a state where the main image (and the clear image) is sufficiently cured and it is possible to suppress image quality deterioration.

In addition, the provisional irradiation units 51*a* and 51*b* (light irradiation units) move in the moving direction with the head 41 and the provisional irradiation units 51*a* and 51*b* are set to be arranged to extend at least in the transport direction spanning from the end portion of the transport direction upstream side of the nozzle groups for the main image and the first clear nozzle groups to the end portion of the transport direction downstream side of the second clear nozzle group. In other words, the provisional irradiation units 51*a* and 51*b* are present at positions equal to the position of the transport direction of the nozzle groups for irradiation (non-ejection region), and, while the main image on the medium corresponds to the nozzle groups for irradiation, the provisional irradiation units 51*a* and 51*b* are set to be capable of irradiating ultraviolet light to the main image.

In addition, without being limited to using the nozzle rows Co and Cl in which the nozzles are lined up every other predetermined interval D in the transport direction, it may be set such that nozzles are not provided between the transport direction of the nozzle groups for the main image and the first clear nozzle groups and the transport direction of the second clear nozzle groups.

Further, the length "4D" of the transport direction of the nozzle groups for irradiation (non-ejection region) may be set to an integer multiple (e.g., four times) of the medium transport amount "D" in a single transport operation. By doing so, it is possible for the main image on the medium to set the number of passes corresponding to the nozzle groups for irradiation to be constant regardless of the position of the transport direction, and it is possible to make constant the time during which ultraviolet light is irradiated by the provisional irradiation units 51*a* and 51*b* on the main image until the clear ink is ejected onto the main image following the printing of the main image. Therefore, it is possible to perform curing sufficiently over the entire main image and to suppress image quality deterioration.

Further, in the same manner, the length of each transport direction of the nozzle group for the main image, the first clear nozzle group, and the second clear nozzle group may also be set to a length of an integer multiple of the medium transport amount (D) in a single transport operation. By doing so, it is possible to print raster lines configuring the main image and raster lines configuring the clear image with a constant number of nozzles (number of passes) respectively, to suppress deterioration in the image quality, and to easily perform print control.

Further, according to the characteristics of the UV ink, the image quality of the desired image, the degree of curing of the main image required before the clear ink is ejected from above, and the like, the irradiation amount of the ultraviolet light to be irradiated to the main image will vary. Here, the length of the transport direction of the nozzle groups for irradiation (non-ejection region) may be varied according to the irradiation amount of the ultraviolet light to be irradiated to the main image from after the printing of the main image to before the clear ink is ejected on the main image.

In other words, the greater the irradiation amount of the ultraviolet light to be irradiated to the main image, the longer the length of the transport direction of the nozzle groups for irradiation. As a result of this, the number of passes in which the main image corresponds to the nozzle groups for irradiation after the printing of the main image increases, and it is possible to eject clear ink from above in a state where the main image is reliably cured. Meanwhile, the smaller the irradiation amount of the ultraviolet light to be irradiated to the main image, the shorter the length of the transport direction of the nozzle groups for irradiation. As a result of this, the number of passes in which the main image unnecessarily corresponds to the nozzle groups for irradiation after the printing of the main image is reduced, and it is possible to shorten the printing time.

Further, when the length of the transport direction of the nozzle groups for irradiation is shortened, instead of reducing the number of passes in which the main image corresponds to the nozzle groups for irradiation after the printing of the main image, the irradiation intensity ($mW/cm^2$) of the ultraviolet light from the provisional irradiation units 51*a* and 51*b* may be increased. By doing so, it is possible to increase the irradiation amount (irradiation intensity of the ultraviolet light× irradiation time) of the ultraviolet light irradiated to the main image from after the printing of the main image to before the clear ink is ejected on the main image, and to shorten the printing time while suppressing deterioration in the image quality.

Further, even in a case where nozzle groups for irradiation are not provided as in the print method shown in the above-described FIGS. 4A to 4C, for example, by increasing the irradiation intensity of the ultraviolet light in the part of the provisional irradiation units 51*a* and 51*b* lined up in the moving direction with the nozzle groups for the main image and the first clear nozzle groups to be greater than the irradiation intensity of the ultraviolet light in the part of the provisional irradiation units 51*a* and 51*b* lined up in the moving direction with the second clear nozzle groups, it is possible to eject clear ink from above in a state where the main image is sufficiently cured.

In addition, to increase the irradiation intensity of the ultraviolet light from the provisional irradiation units 51*a* and 51*b*, for example, the current applied to the provisional irradiation units 51*a* and 51*b* may be increased, or the number of irradiation light sources (for example, the number of LED packages) may be increased.

In addition, above, an example has been given of unidirectional printing; however, without being limited thereto, a printing method in which ink is ejected from the head 41 when the head 41 moves to the left side in the moving direction as well as when moving to the right side (that is, bi-directional printing) may be employed. Further, regardless of the direction in which the head 41 moves, the two provisional irradiation units 51*a* and 51*b* may always be set to irradiate ultraviolet light. In addition, in FIGS. 4A to 5B, the lengths of the transport directions of the provisional irradiation unit 51*a* and the nozzle rows Co and Cl are made to be equal; however, without being limited thereto, the provisional irradiation units 51*a* and 51*b* may be extended to downstream side of the transport direction further than the nozzle rows Co and Cl. By doing so, it is possible to sufficiently cure the clear image using the second clear nozzle group.

Print Method

Third Embodiment

In the above-described first embodiment and second embodiment, an example was given of a printing method of coating a main image with clear ink using four colored inks (CMYK). In contrast, in the third embodiment, an image in which a background image and a main image are overlapped using white ink is coated with clear ink. In other words, a case where three types of images consisting of a background image, a main image, and a clear image are overlapped and printed will be given as an example. By overlapping the main image and the background image, for example, it is possible to improve the color of the main image when the medium is not white, or prevent the opposite side of the main image from becoming transparent when the medium is transparent.

In addition, in the third embodiment, printing is performed using a head 41 having a white nozzle row W ejecting white ink in addition to the five nozzle rows (CMYK and Cl) belonging to the head 41 shown in FIG. 2B. Further, a surface printing mode printing images in the order of the background image, the main image, and the clear image may be adopted so as to view the main image from the printing surface side, or a rear printing mode printing images in the order of the main image, the background image, and the clear image may be adopted so as to view the main image through the medium. However, below, description will be given of the surface printing mode as an example.

Print Method of Comparative Example

Figure 6A:
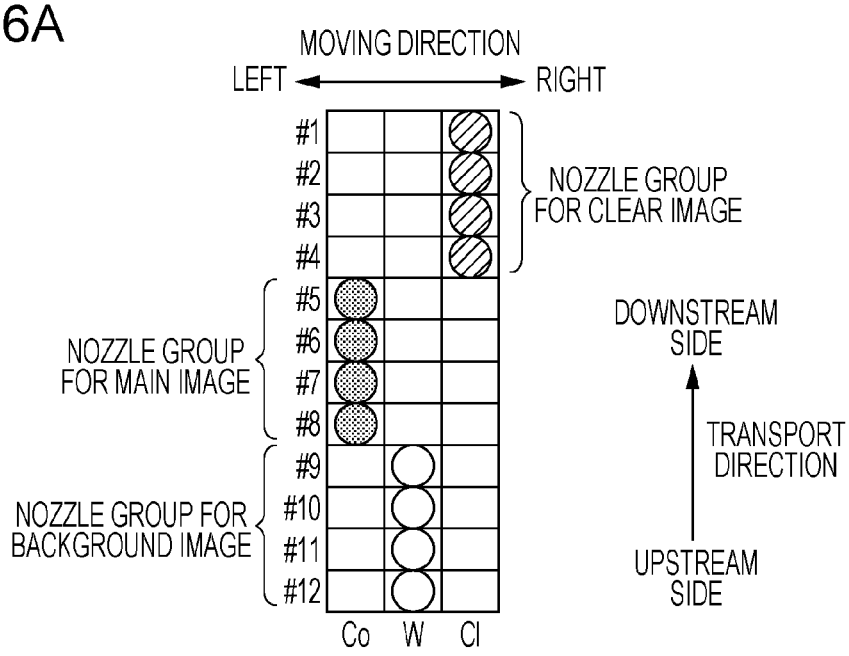
FIG. 6A is a diagram illustrating a nozzle used in the printing method of a comparative example.
Figure 6B:
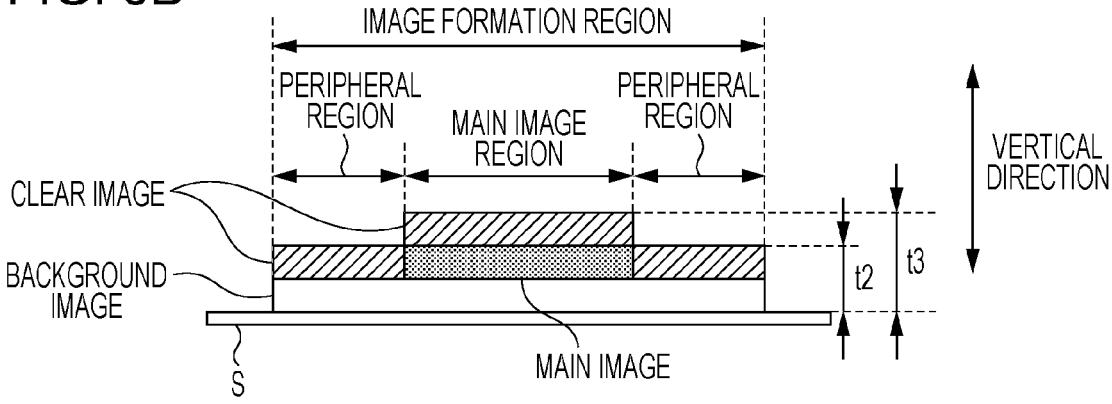
FIG. 6B and FIG. 6C are diagrams illustrating an image printed by the printing method of a comparative example.
Figure 6C:
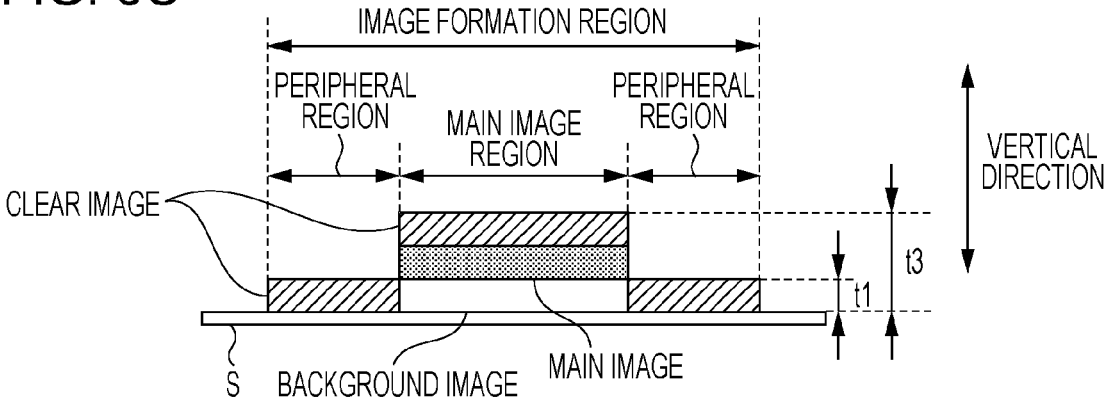

FIG. 6A is a diagram illustrating a nozzle used in the printing method of a comparative example. FIG. 6B and FIG. 6C are diagrams illustrating an image printed by the printing method of a comparative example. In the comparative example, nozzle groups (#1 to #4) of one third of the transport direction downstream side of the clear nozzle row Cl are referred to as nozzle groups for a clear image, nozzle groups (#5 to #8) of one third of the transport direction center of the color nozzle row Co are referred to as nozzle groups for the main image, and nozzle groups (#9 to #12) of one third of the transport direction upstream side of the white nozzle row W are referred to as nozzle groups for a background image. In other words, in the comparative example, the nozzle groups respectively printing three types of images are shifted in the transport direction.

In the case of such a nozzle set, since a predetermined region of the medium corresponds first to the nozzle groups for a background image, a background image is formed in a region (in FIG. 6B, the entire image forming region and in FIG. 6C, the main image region) forming a background image in the predetermined region of the medium. Next, since the predetermined region of the medium corresponds to the nozzle group for the main image, the main image is formed on the background image in the main image region in the predetermined region of the medium. Finally, since the predetermined region of the medium corresponds to the nozzle group for the clear image, the clear image is formed on the entire image forming region in the predetermined region of the medium.

As a result, when the background image is formed over the entire image forming region, as shown in FIG. 6B, it is possible to form a two layer image in which the background image and the clear image are overlapped at the peripheral region and to form a three layer image in which the background image, the main image, and the clear image are overlapped at the main image region. Thus, there are parts with different thicknesses within the image, and step difference is generated in the image. Further, when the background image and the main image are the same size, as shown in FIG. 6C, only a clear image is formed in the peripheral region and a three layer image in which the background image, the main image, and the clear image are overlapped is formed at the main image region. Thus, the step difference generated within the image becomes greater.

Print Method of Third Embodiment

Figure 7A:
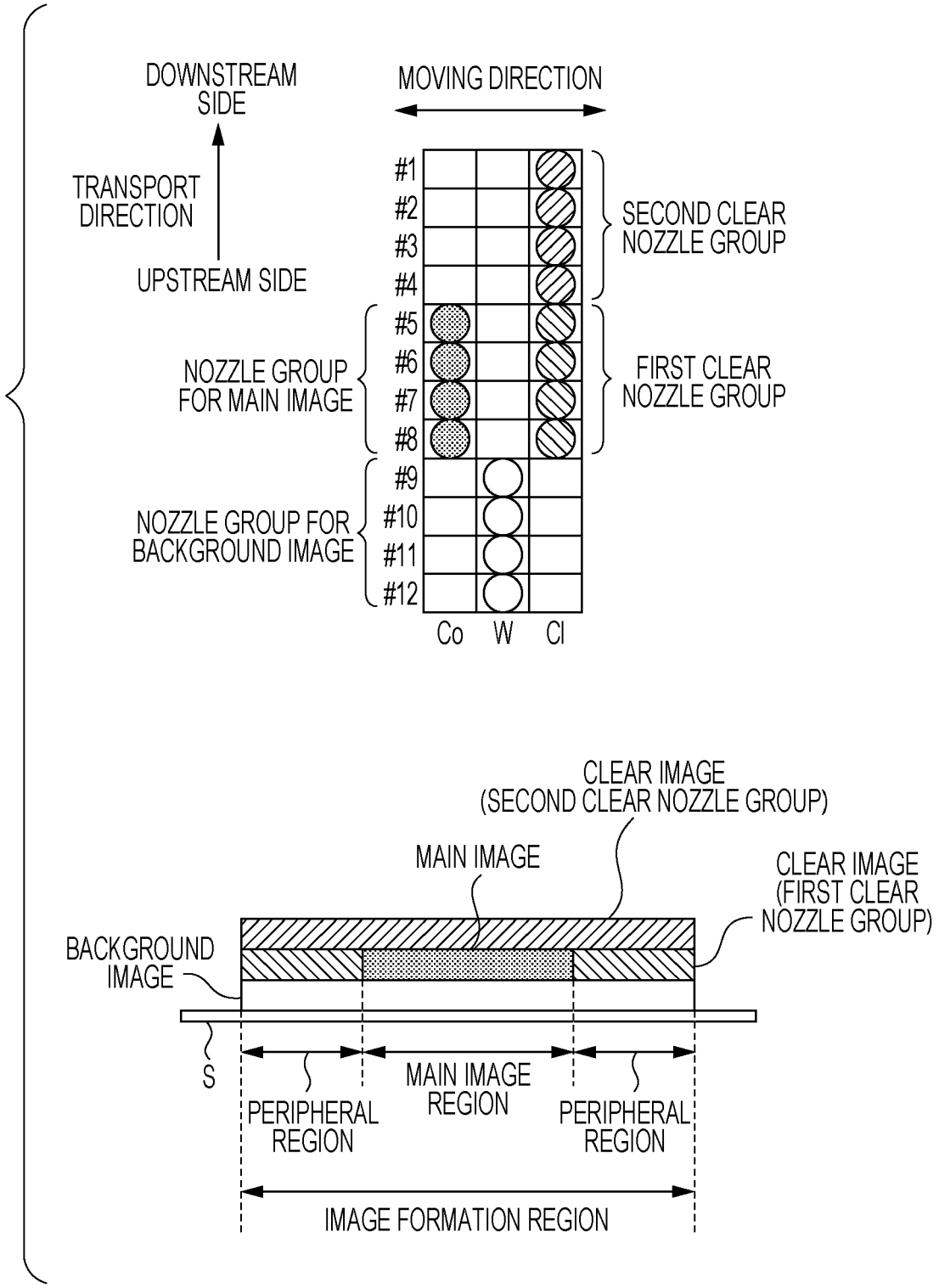
FIG. 7A and FIG. 7B are diagrams illustrating a nozzle used in a printing method of a third embodiment and a printed image.
Figure 7B:
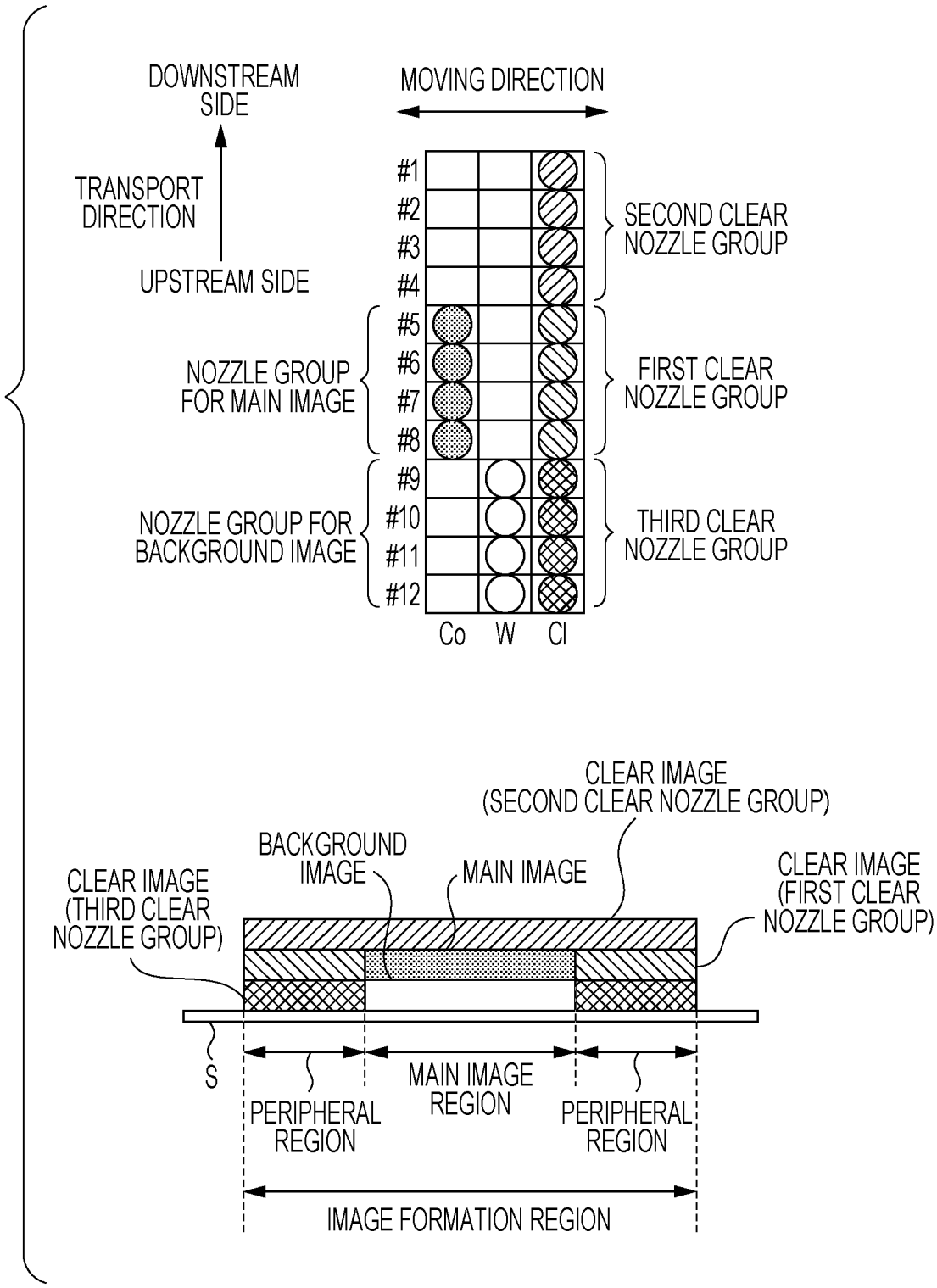

FIG. 7A and FIG. 7B are diagrams illustrating a nozzle used in a printing method of a third embodiment and an image printed by the third embodiment.

When the background image is larger than the main image and the background image is formed over the entire image forming region, in the third embodiment, as shown in the left diagram of FIG. 7A, nozzle groups (#9 to #12) of one third of the transport direction upstream side of the white nozzle row W are referred to as "nozzle groups for a background image", nozzle groups (#5 to #8) of one third of the transport direction center of the color nozzle row Co are referred to as "nozzle groups for the main image", nozzle groups (#5 to #8) of one third of the transport direction center of the clear nozzle row Cl are referred to as "first clear nozzle groups", and nozzle groups (#1 to #4) of one third of the transport direction downstream side are referred to as "second clear nozzle groups".

Here, the controller 10, first, ejects white ink from the nozzle group for the background image over the entire image formation region, next, ejects four colored inks (CMYK) from the nozzle group for the main image to the main image region in the image forming region, ejects clear ink from the first clear nozzle group to the peripheral region in the image forming region, and, finally, ejects clear ink from the second clear nozzle group to the entire image formation region.

As a result, as shown in the right diagram of FIG. 7A, it is possible to form a three layer image in which the background image, the main image, and the clear image are overlapped in the main image region and it is possible to form a three layer image in which the background image is overlapped with two clear images in the peripheral region. Therefore, since it is possible to set the image thickness to be almost constant and to suppress step difference generated in the image, it is possible to provide a sense of glossiness to the image, or to prevent the rubbing or peeling off of the image.

In this manner, when the background image and the image forming region are the same size, clear ink is ejected from the nozzle groups of the clear nozzle row Cl lined up with the nozzle groups for the main image in the moving direction; however, clear ink is not ejected from the nozzle groups of the clear nozzle row Cl lined up with the nozzle groups for the background image in the moving direction.

On the other hand, when the background image formed in the image forming region is smaller than the image forming region, as shown in the left diagram of FIG. 7B, nozzle groups (#9 to #12) of one third of the transport direction upstream side of the white nozzle row W are referred to as "nozzle groups for a background image (corresponding to the fourth nozzle group)", nozzle groups (#5 to #8) of one third of the transport direction center of the color nozzle row Co are referred to as "nozzle groups for the main image", nozzle groups (#5 to #8) of one third of the transport direction center of the clear nozzle row Cl are referred to as "first clear nozzle groups", nozzle groups (#1 to #4) of one third of the transport direction downstream side are referred to as "second clear nozzle groups", and nozzle groups (#9 to #12) of one third of the transport direction upstream side are referred to as "third clear nozzle groups (corresponding to the fifth nozzle group)".

Here, the controller 10, first, ejects white ink from the nozzle group for the background image to the region (main image region in FIG. 7B) where the background image is formed in the image formation region, ejects clear ink from the third clear nozzle group to the region (peripheral region in FIG. 7B) where the background image is not formed in the image formation region, and, thereafter, ejects four colored inks (CMYK) from the nozzle groups for the main image to the main image region in the image forming region, ejects clear ink from the first clear nozzle group to the peripheral region in the image forming region, and, finally, ejects clear ink from the second clear nozzle group to the entire image formation region.

In this manner, when the background image formed in the image forming region is smaller than the image forming region, in different passes to the passes forming the main image (in another ejection operation), white ink is ejected from the nozzle groups for a background image positioned at the transport direction upstream side relative to the second clear nozzle groups in the region where the background image is formed in the image forming region, and clear ink is ejected from the third clear nozzle groups lined up in the moving direction with the nozzle groups for a background image in the region where the background image is not formed in the image forming region.

As a result, as shown in the right diagram of FIG. 7B, it is possible to form a three layer image in which the background image, the main image, and the clear image are overlapped in the main image region and it is possible to form a three layer image in which three clear images are overlapped in the peripheral region. Therefore, since it is possible to set the image thickness to be almost constant and to suppress step difference generated in the image, it is possible to provide a sense of glossiness to the image, or to prevent the rubbing or peeling off of the image.

In addition, when a rear printing mode in which the main image is printed before the background image is adopted, the nozzle groups positioned to the transport direction downstream side relative to the nozzle groups for the main image and the first clear nozzle groups may be set to the nozzle groups for a background image (and the third clear nozzle groups).

Figure 8:
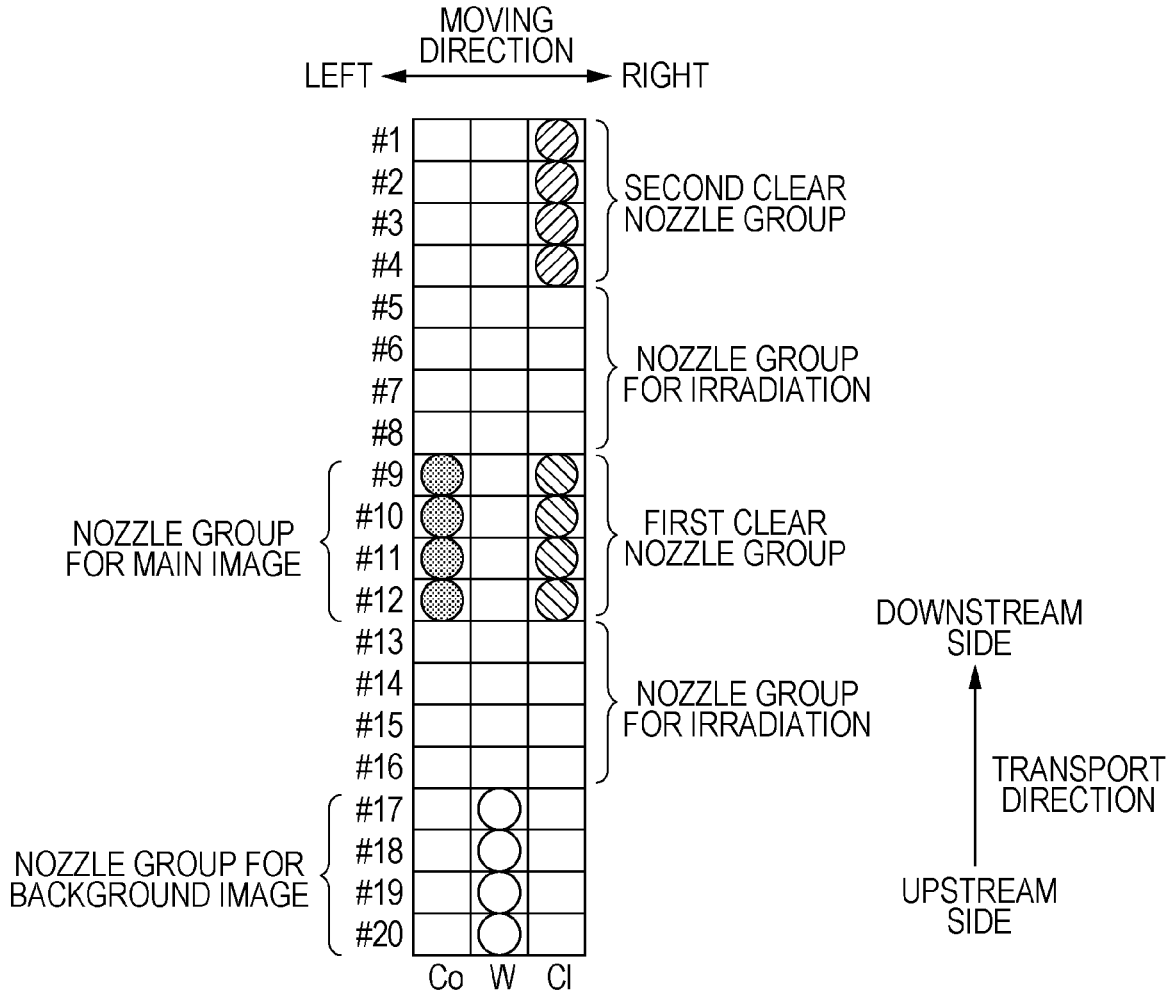
FIG. 8 is a diagram illustrating a nozzle set of a modification example of the third embodiment.

FIG. 8 is a diagram illustrating a nozzle set of a modification example of the third embodiment. In order to superimpose the upper layer image in a state where the lower layer image is sufficiently cured, as in the second embodiment, the nozzle groups for irradiation (non-ejection region) may be provided between the nozzle groups for printing each image.

More specifically, nozzle groups (#13 to #16 of Co, W, and Cl) between the transport directions of the "nozzle groups for a background image", which are nozzle groups (#17 to #20) of one fifth of the transport direction upstream side of the white nozzle row W, and the "nozzle groups for the main image" and "first clear nozzle groups", which are nozzle groups (#9 to #12) of one fifth of the transport direction center of the color nozzle row Co and the clear nozzle row Cl, are referred to as "nozzle groups for irradiation". In addition, nozzle groups (#5 to #8 of Co, W, and Cl) between the transport directions of the "second clear nozzle groups", which are nozzle groups (#1 to #4) of one fifth of the transport direction downstream side of the clear nozzle row Cl, the "nozzle groups for the main image" and the "first clear nozzle groups", are referred to as the "nozzle groups for irradiation".

By doing so, after the background image has been printed in a predetermined region of the medium, since the background image corresponds to the nozzle groups for irradiation, sufficient curing is performed therebetween by the ultraviolet light from the provisional irradiation units 51*a* and 51*b*. In addition, after the main image and the clear image are printed on the background image, since the main image and the clear image correspond to the nozzle groups for irradiation, sufficient curing is performed therebetween by the ultraviolet light from the provisional irradiation units 51*a* and 51*b*. Thus, it is possible to superimpose an upper layer image in a state where the lower layer image is sufficiently cured and it is possible to suppress image quality deterioration.

Modification Examples

Modification Example 1

In the embodiment above, ultraviolet curable ink (UV ink) was given as an example of a photocurable ink; however, without being limited thereto, for example, ink cured by being irradiated with visible light may be used.

In addition, without being limited to photocurable ink, for example, a water-based ink or an organic solvent based ink penetrating the medium may be used. Even if the ink is not photocurable ink, since the thickness of the image due to the high viscosity ink is great, similar issues arise. Therefore, in a printer that uses high-viscosity inks, the print method of the present embodiment (for example, FIG. 4) may be executed.

Moreover, even in a case where photocurable ink is not used, as in the second embodiment, by providing nozzle groups for irradiation between the nozzle groups for printing the image, it is possible to superimpose an upper layer image in a state where the lower layer image is sufficiently dried and it is possible to prevent bleeding and color mixing in the image.

Modification Example 2

In the above-described embodiment, the auxiliary ink is set as clear ink; however, without being limited thereto, for example, the auxiliary ink may be set as ink printing a background image (for example, white ink, or metallic inks). In this case, after the main image is printed in the region where the main image is formed and the background image is printed in the region where the main image is not formed, by superimposing the background image from above over the entire region where the main image and the background image are printed, it is possible to print an image without step difference.

In addition, in the above-described third embodiment, the background image is printed only with white ink; however, the invention is not limited thereto. Since the shade of the white differs slightly according to the type of the white ink, when printing is performed using only white ink, the color of the white ink itself becomes the color of the background image. Further, a background image having a slight chromatic color instead of simple white may be desired. Therefore, it is also possible to print the desired white background image (adjusted white background image) by appropriately using white ink and small amounts of four colored inks (CMYK). In addition, in contrast, by mixing the four colored inks with the white ink, it may be possible to counteract the slight chroma of the white ink. Further, the background image is not limited to being white and the background image may be printed using color ink other than white ink (for example, metallic inks). Furthermore, the main image is not limited to being printed only with the four colored inks (CMYK), but the main image may be printed by mixing the white ink with the four colored inks.

Modification Example 3

In the above-described embodiments, the length of the transport direction of the nozzle groups for the main image and the length of the transport direction of the second clear nozzle groups positioned at the transport direction downstream side relative to the nozzle groups for the main image are set to be equal; however, the invention is not limited thereto. For example, since the clear image does not need to be printed with image quality as high as the main image (that is, since there is no need to increase the print resolution), the length of the transport direction of the second clear nozzle group may be made shorter than the length of the transport direction of the nozzle group for the main image (that is, the number of nozzles belonging to the second clear nozzle group may be reduced). Instead, in order to improve the filling in of the medium with the clear ink, for example, the amount of ink ejected from the second clear nozzle groups at one time may be increased to more than the amount of ink ejected from the nozzle groups for the main image at one time.

Other Embodiments

The above-described embodiments mainly disclose an image forming apparatus; however, disclosure of an image forming method or the like is also included. In addition, the above-described embodiments are intended to facilitate understanding of the invention and should not be interpreted as limiting the invention. It is needless to say that the invention may be modified and improved within a range not exceeding the gist of the invention and furthermore, that the invention also includes equivalents thereto.

Printer

In the above-described embodiments, an example has been given of a printer repeating the ejection operation ejecting ink from the head moving in the moving direction and the transport operation transporting the medium in the transport direction; however, the invention is not limited thereto. For example, the printer may be a printer in which, with respect to continuous paper transported in the print region, an operation of forming an image while the head is moved in the medium transport direction and an operation of moving the head in the paper width direction are repeated to form an image, after which the medium portion which is not yet printed is transported to the print region.

White

In the specification, "white" is not limited to white in the strict sense of a surface color of an object reflecting 100% of all visible light wavelengths but, as commonly accepted, includes colors referred to as white such as so-called "whitish colors". "White", for example, may mean: (1) when colorimetry is performed with Colorimetry mode using a colorimeter Eye-One Pro manufactured by X-Rite: spot colorimetry, Light source: D50, Backing: black, and Print medium: transparent film, a color for which the heading of the Lab system is the circumference of a radius 20 on an a*b* flat surface and the inside thereof and for which L* is within a color phase range expressed by 70 or more, (2) when colorimetry is performed with a field of vision of a measurement mode D502° using a colorimeter CM2022 manufactured by Minolta, an SCF mode, and a white background, a color for which the heading of the Lab system is the circumference of a radius 20 on an a*b* flat surface and the inside thereof and for which L* is within a color phase range expressed by 70 or more, and (3) a color of an ink used as the background of an image as disclosed in JP-A-2004-306591, and as long as the white may be used as a background, the white is not limited to being a pure white.

What is claimed is:

1. An image forming apparatus comprising:

(A) a first nozzle group in which nozzles ejecting ink forming a main image are lined up in a first direction;

(B) a second nozzle group, in which nozzles ejecting auxiliary ink are lined up in the first direction, and lined up with the first nozzle group in a second direction which is perpendicular to the first direction;

(C) a third nozzle group, in which nozzles ejecting the auxiliary ink are lined up in the first direction, positioned on one side of the first direction relative to the first nozzle group and the second nozzle group and downstream of the first nozzle group and the second nozzle group; and (D) a control unit that repeatedly performs an ejection operation ejecting ink from the nozzles while relatively moving the nozzle groups and a medium in the second direction and a position changing operation changing a relative position of the medium with respect to the nozzle groups to one side of the first direction, in which, in a first ejection operation, ink is ejected from the first nozzle group on a region where the main image is formed in the image forming region on the medium, the auxiliary ink is ejected from the second nozzle group on a region where the main image is not formed in the image forming region, and, the auxiliary ink is ejected from the third nozzle group previously deposited ink and auxiliary ink.

2. The image forming apparatus according to claim 1, wherein the ink forming the main image and the auxiliary ink are photocurable ink cured by irradiation of light.

3. The image forming apparatus according to claim 2, further comprising:

a light irradiating unit that irradiates light to the photocurable ink and is arranged to extend in at least the first direction covering from an end portion of another side of the first direction of the first nozzle group and the second nozzle group to an end portion of the one side of the first direction of the third nozzle group, wherein, in the ejection operation, the medium is relatively moved in the second direction with respect to the light irradiating unit and the nozzle groups, and a non-ejection region where ink is not ejected is provided between the and the second nozzle groups and the third nozzle group in the first direction.

4. The image forming apparatus according to claim 1, further comprising:

a fourth nozzle group, in which nozzles ejecting ink forming a background image of the main image are lined up in the first direction, positioned on the other side of the first direction relative to the third nozzle group; and a fifth nozzle group, in which nozzles ejecting the auxiliary ink are lined up in the first direction, lined up with the fourth nozzle group in the second direction, wherein, when the background image formed on the image forming region is smaller than the image forming region, the control unit performs a second ejection operation ejecting ink from the fourth nozzle group to the region where the background image is formed in the image forming region and ejecting the auxiliary ink from the fifth nozzle group to the region where the background image is not formed in the image forming region.

5. An image forming method forming an image on a medium using an image forming apparatus comprising a first nozzle group in which nozzles ejecting ink forming a main image are lined up in a first direction; a second nozzle group, in which nozzles ejecting auxiliary ink are lined up in the first direction, lined up with the first nozzle group in a second direction which is perpendicular to the first direction; and a third nozzle group, in which nozzles ejecting the auxiliary ink are lined up in the first direction, positioned on one side of the first direction relative to the first nozzle group and the second nozzle group and downstream of the first nozzle group and the second nozzle group the image forming method comprising;

performing repeatedly an ejection operation ejecting ink from the nozzles while relatively moving the nozzle groups and the medium in the second directions and a position changing operation changing the relative position of the medium with respect to the nozzle groups to one side of the first direction, and performing a first ejection operation, ejecting ink from the first nozzle group on the region where the main image is formed in the image forming region on the medium, ejecting the auxiliary ink from the second nozzle group on the region where the main image is not formed in the image forming region, and ejecting the auxiliary ink from the third nozzle group over previously deposited ink and auxiliary ink.

* * * * *